US005190507A

United States Patent [19]

Iijima

[11] Patent Number: 5,190,507

[45] Date of Patent: Mar. 2, 1993

[54] APPARATUS FOR PRACTICE OF AMBULATION

[75] Inventor: Kenji Iijima, Hamamatsu, Japan

[73] Assignee: Japan EM Co. Ltd., Shizuoka, Japan

[21] Appl. No.: 647,830

[22] Filed: Jan. 30, 1991

[51] Int. Cl.[5] ..... A61H 1/02

[52] U.S. Cl. ..... 482/69; 128/25 R

[58] Field of Search ..... 482/51, 69, 4–9; 128/25 R; 294/118

[56] References Cited

U.S. PATENT DOCUMENTS 4,907,571 3/1990 Futakami ..... 482/69
4,948,118 8/1990 Miraglia ..... 482/69
4,973,044 11/1990 Jones ..... 482/69
5,050,590 11/1991 Futakami ..... 482/69

*Primary Examiner*—Randall L. Green
*Assistant Examiner*—R. Clarke
*Attorney, Agent, or Firm*—Helfgott & Karas

[57] ABSTRACT

An apparatus for practice of ambulation comprises a person suspending unit, a suspension force generating unit, and a restoring force generating unit. When a person walks out of a predetermined path, this is detected by the restoring force generating unit. Then, the suspension force generating unit is inclined dependent on the detected value of the restoring force generating unit, so that inclined suspension force is generated. As a result, a horizontal component of the suspension force becomes a restoring force.

4 Claims, 8 Drawing Sheets

D
B1
A1
1
1a
2
3
4
5
6
7
8
9
10
11
C

APPARATUS FOR PRACTICE OF AMBULATION

FIELD OF THE INVENTION

This invention relates to an apparatus for practice of ambulation, and more particularly to, an apparatus for practice of ambulation, in which a restoring force is generated to apply to a walking person.

BACKGROUND OF THE INVENTION

A conventional apparatus for practice of ambulation comprises a vertical arm for suspending a walking person, and first and second horizontal arms for supporting the vertical arm. The first horizontal arm is held horizontally to move in the horizontal direction, and the second horizontal arm is held horizontally to move in the vertical direction, and bears a weight of a person walking on a circular path having a predetermined radius. When the person walks out of the circular path, the vertical arm follows the walking person by the horizontal and vertical movements of the first and second arms, so that the walking person is supported by the vertical arm. Consequently, the practice of ambulation can be carried out for a person having a low walking ability or less ability of controlling a walking direction.

However, the conventional apparatus for practice of ambulation has a disadvantage in that the construction is complicated, because the first and second horizontal arms are guided to move in the horizontal and vertical directions.

For the purpose of overcoming this disadvantage, there has been proposed another apparatus for practice of ambulation which comprises a horizontal arm for suspending a walking person at one end thereof, two parallel arms for supporting the other end of the horizontal arm at one ends thereof, and a piston having a piston rod to be moved horizontally and connected to the other ends of the two parallel arms. In this apparatus for practice of ambulation, the horizontal arm moves horizontally in compliance with the motion of a walking person, while the two parallel arms shift from the vertical posture to the slant state by the horizontal movement of the piston. Consequently, the walking person is followed by the single guide means to overcome the aforementioned disadvantage.

However, the latter apparatus for practice of ambulation has the disadvantage in that a person can take a position outside of a predetermined circular path so that a person having less control ability of a walking direction can not return to the circular path, because the suspending horizontal arm follows the walking person freely. Furthermore, there is a disadvantage in that an apparatus cost is increased, because means for guiding the piston structure horizontally is provided, and a motion resistance of the piston structure is required to be lowered.

SUMMARY OF THE INVENTION

Accordingly, it is an object of this invention to provide an apparatus for practice of ambulation, in which a restoring force is generated, when a person walks out of a predetermined path.

It is a further object of this invention to provide an apparatus for practice of ambulation having no necessity of providing a horizontal guide structure to lower an apparatus cost.

It is still further object of this invention to provide an apparatus for practice of ambulation, in which a suspension force is controlled to be equal to or less than a set value.

According to this invention, an apparatus for practice of ambulation, comprises:

means for suspending a person making practice of ambulation by a predetermined suspension force;

means for generating the predetermined suspension force; and means for generating a restoring force to restore the person to a predetermined path, when the person is out of the predetermined path;

wherein the restoring force is generated in accordance with an inclination of the suspension force generating means by detecting the person to be out of the predetermined path.

BRIEF DESCRIPTION OF THE DRAWINGS

This invention will be described in more detail in conjunction with appended drawings, wherein.

DESCRIPTION OF THE PREFERRED EMBODIMENTS

Figure 1:
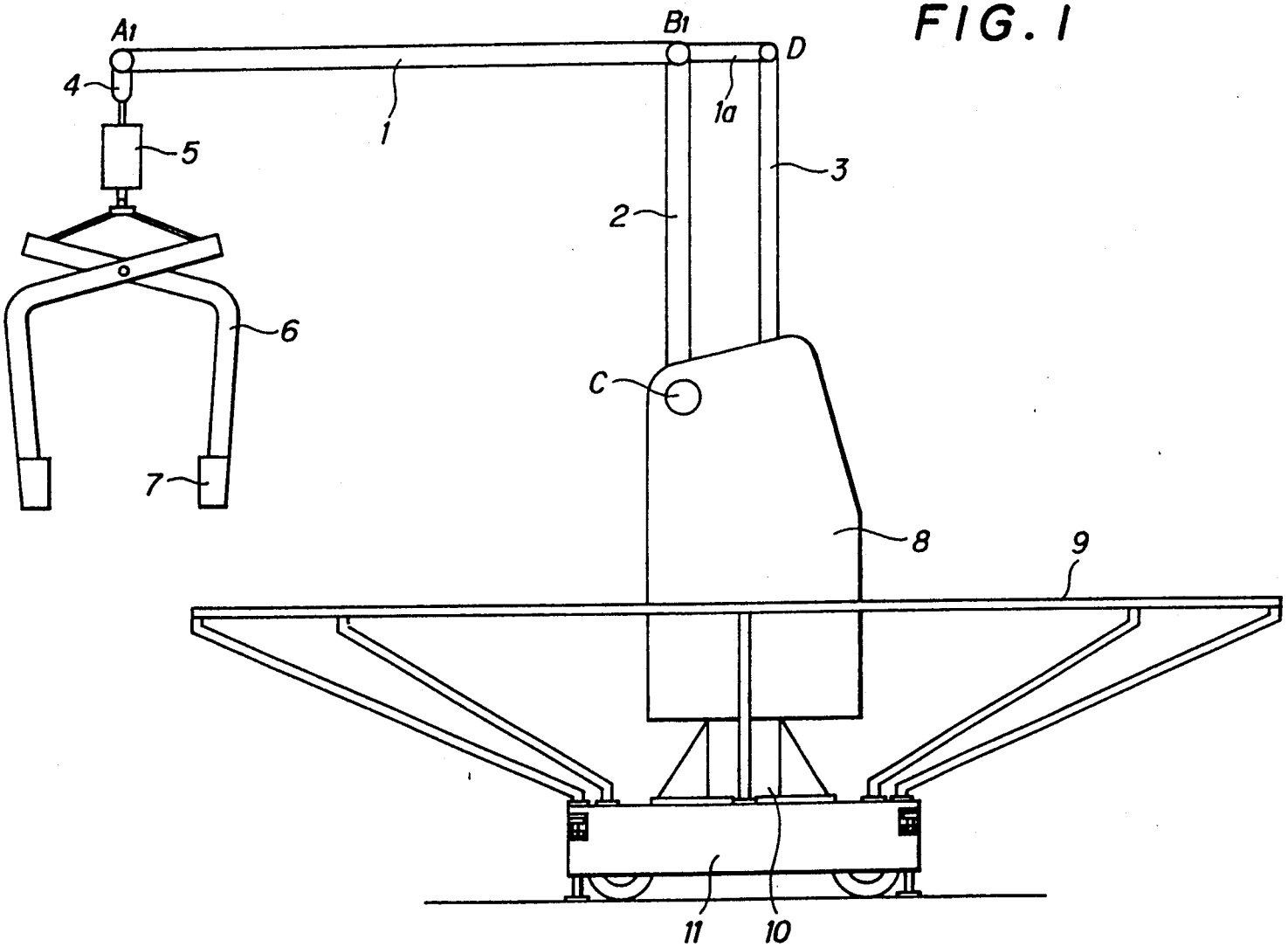
FIG. 1 is an explanatory diagram showing an apparatus for practice of ambulation in a first preferred embodiment according to the invention.

FIG. 1 shows an apparatus for practice of ambulation which comprises a pole brace 10 provided on a truck 11, a main body 8 provided to be rotated around the pole brace 10, a circular hand rail 9 provided to surround the main body 8, two parallel arms 2 and 3 provided to be extended from the main body 8, a horizontal arm 1 supported by an end of the parallel arm 2, and a suspension device 6 having side pads 7 suspended from an end of the horizontal arm 1 by providing a level adjusting arm 4 and a load sensor 5 therebetween. In this apparatus for practice of ambulation, the parallel arm 2 is fixed at a pivotal point C to the main body 8, and the two parallel arms 2 and 3 are connected at joint points $B_1$ and D with the horizontal arm 1 and a connecting arm 1*a*, respectively. In addition, the horizontal arm 1 is connected at a joint point $A_1$ with the level adjusting arm 4.

The apparatus for practice of ambulation in the first preferred embodiment will be explained in more detail in FIGS. 2A to 2C.

Figure 2A:
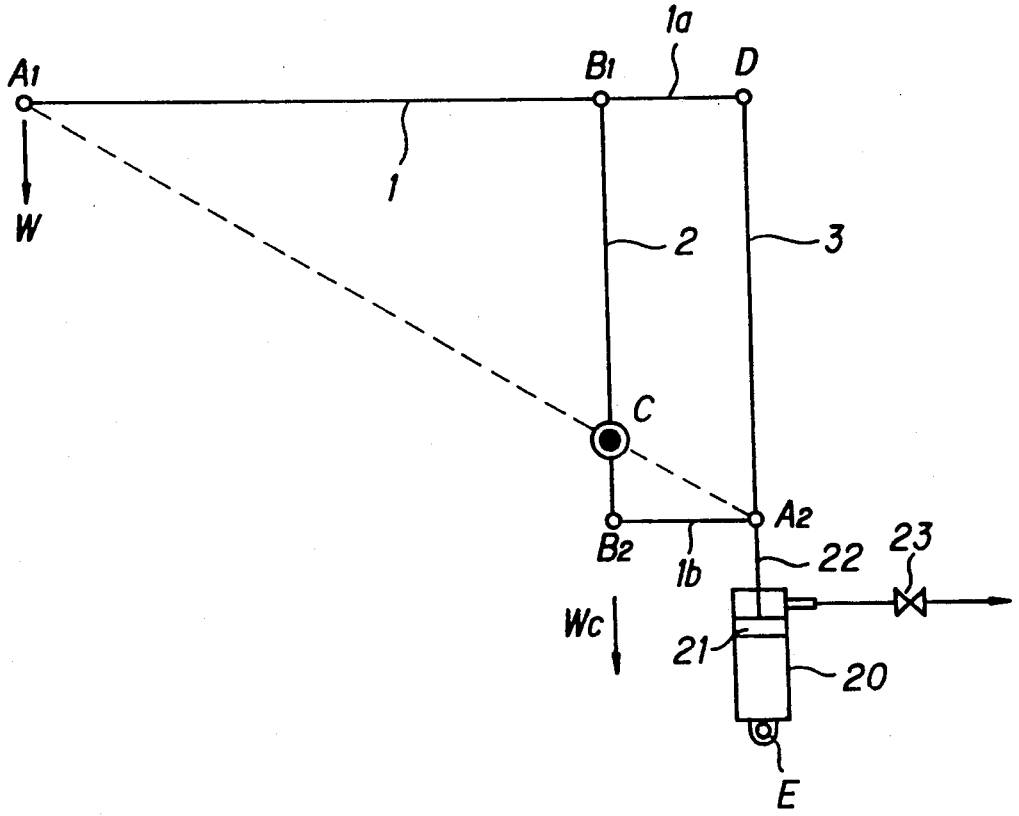
FIGS. 2A, 2B and 2C are explanatory diagrams showing operation of the apparatus for practice of ambulation in the first preferred embodiment according to the invention.

In FIG. 2A, the parallel arms 2 and 3 are connected at joint points $B_2$ and $A_2$ with a connecting arm 1*b* in addition to the connecting arm 1*a*. The joint point $A_2$ is connected to a piston rod 22 connected with a piston 21 contained in a cylinder 20 which is fixed to a pivotal point E. The cylinder 20 is connected via a valve 23 to a fluid pressure source such as an air pressure source (not shown), so that a suspension force generated at the joint point $A_1$ of the horizontal arm 1 is adjusted by a pressure value of the cylinder 20. Additionally, a counter weight (not shown) is provided at the joint point $B_2$ to make a balance at the time of no load. The aforementioned pivotal point C is positioned to provide two similar triangles $\Delta A_1 B_1 C$ and $\Delta A_2 B_2 C$.

In operation, when no load (W=0) is suspended at the joint point $A_1$, that is, no person is suspended by the suspension device 6, a weight of the horizontal arm 1, etc. is only balanced relative to a weight Wc of the counter weight. When a person is suspended for practice of ambulation by the suspension device 6, a suspension load W is generated at the joint point $A_1$. This suspension load W is detected by the load sensor 5, so that an inner pressure of the cylinder 20 is increased by introducing air via the valve 23 thereto. Thus, a suspension force is conveyed from the piston 21 through the piston rod 22 to the joint point $A_1$. This suspension force is balanced relative to the suspension load W, so that the suspended person can walk along the hand rail 9.

Figure 2B:
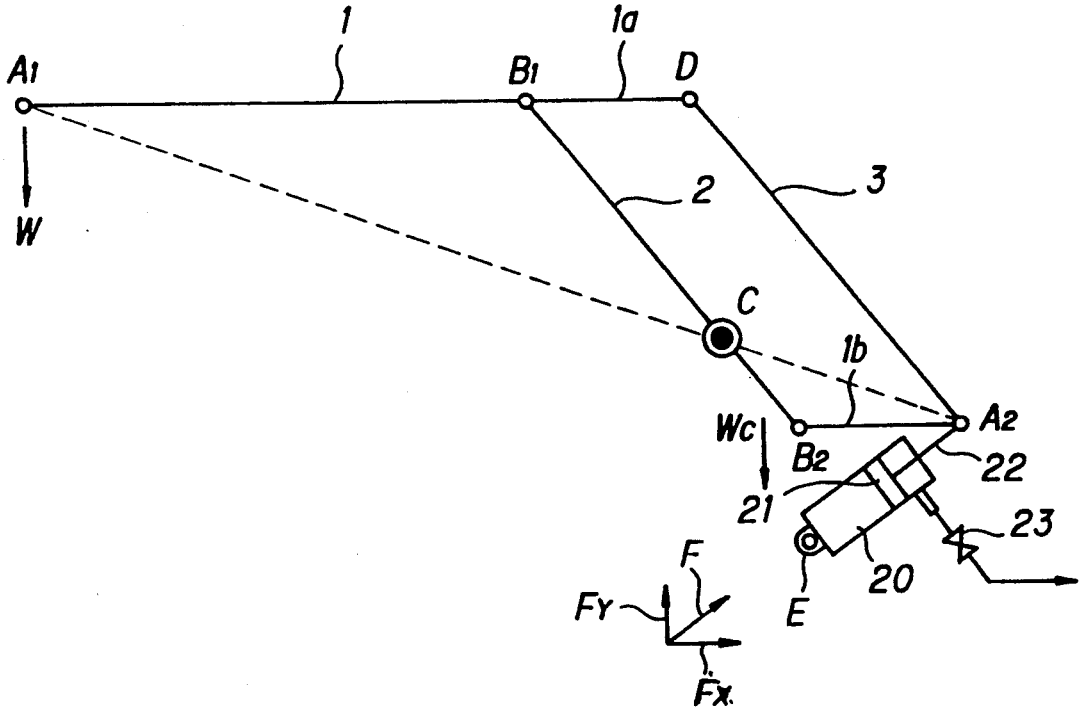

When the person walks out of the path to the left, as shown in FIG. 2B, the joint points $B_1$ and D shift to the left together with the horizontal arm 1, and the joint points $A_2$ and $B_2$ shift to the right, so that the parallel arm 2 is inclined by the counter clockwise rotation of the parallel arm 2 on the pivotal point C. Thus, the cylinder 20 is rotated on the pivotal point E in the clockwise direction, because the piston rod 22 is connected to the joint point $A_2$. As a result, a suspension force F which is divided into X- and Y-direction forces $F_X$ and $F_Y$ is inclined to a degree dependent on a displacement of the walking person, and conveyed from the piston 21 through the piston rod 22 to the joint point $A_2$. In this situation, the vertical component $F_Y$ is balanced relative to the suspension load W, and the horizontal component $F_X$ is balanced relative to a restoring force, by which the walking person is restored to a predetermined path. When the vertical component $F_Y$ is not balanced relative to the suspension load W, an internal pressure of the cylinder 20 is controlled to provide a balance therebetween.

Figure 2C:
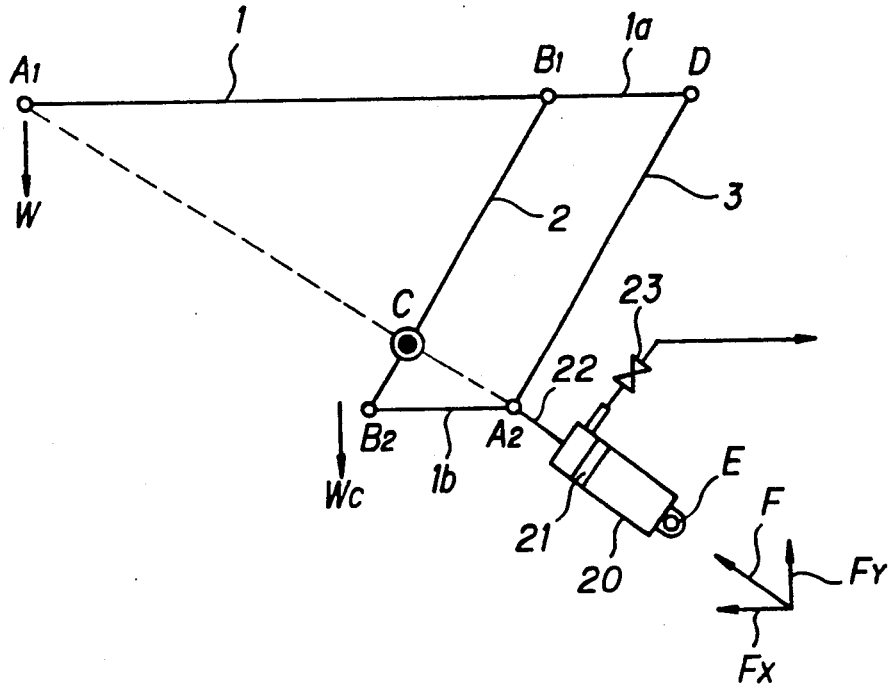

When the suspended person walks out of the path to the left, as shown in FIG. 2C, the cylinder 20 is inclined by the counter clockwise rotation thereof on the pivotal point E. As a result, the horizontal component $F_X$ which is opposite to the direction of FIG. 2B is generated, so that the walking person is restored to the path in the same manner as in FIG. 2B.

Figure 3A:
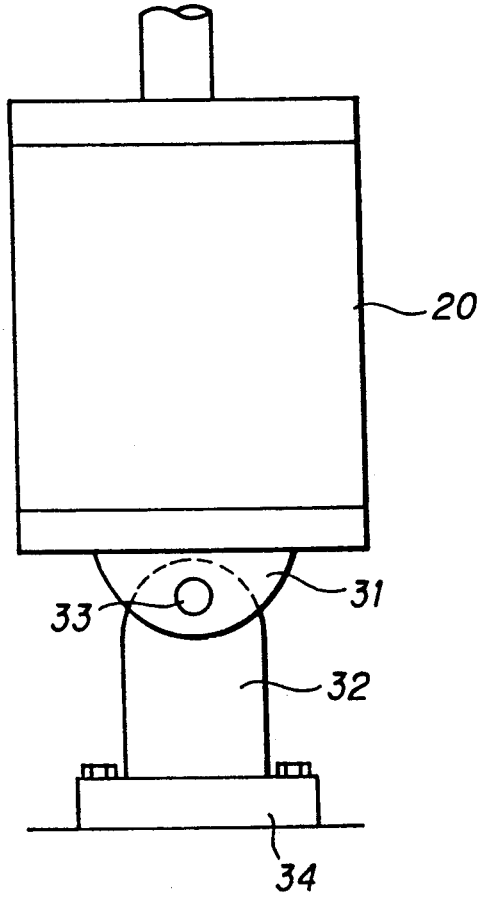
FIGS. 3A and 3B are front and partial cross-sectional views showing a pivot structure of a cylinder apparatus used in the apparatus of FIGS. 2A, 2B and 2C.
Figure 3B:
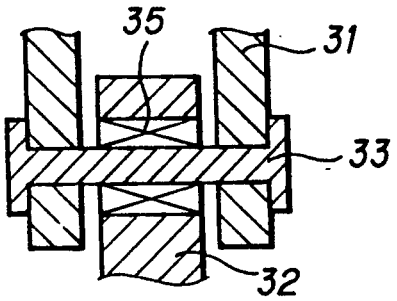

FIG. 3A and 3B show a structure of the pivotal point E for the cylinder 20. In this structure, a pivot member 32 is fixed to a fixed member 34, and a flange 31 provided at a lower end of the cylinder 20 is connected to the pivot member 32 by a pin 3 extending through a bearing 35 provided at the connected end of the pivot member 32. For this structure, the cylinder 20 is inclined in an arbitrary direction in the state that a pivotal resistance is substantially zero.

Figure 4:
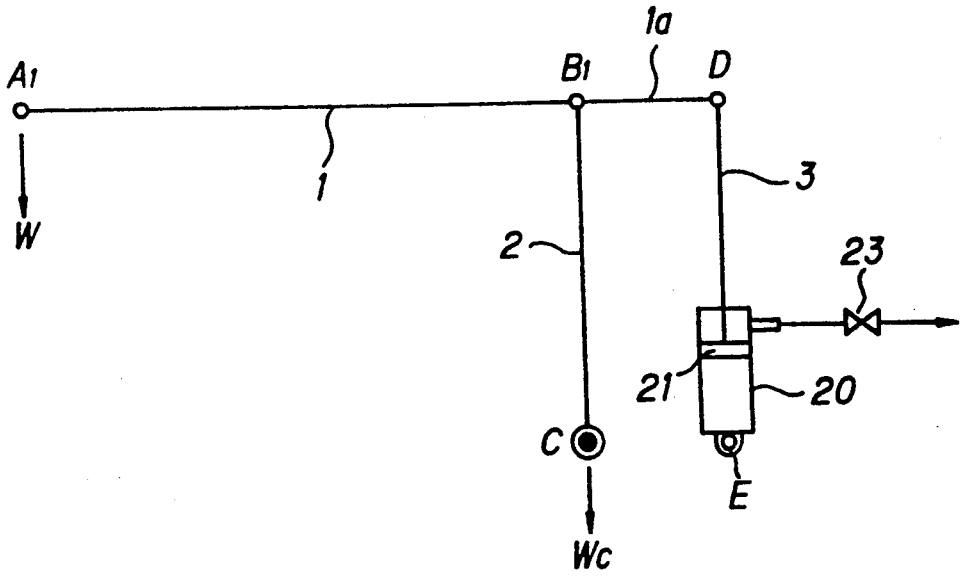
FIGS. 4 and 5 are explanatory diagrams showing apparatus for practice of ambulation in second and third preferred embodiments according to the invention.

FIG. 4 shows an apparatus for practice of ambulation in the second preferred embodiment according to the invention, wherein like parts are indicated by like reference numerals. In this preferred embodiment, the connecting arm **1*b* is not provided, and the end of the parallel arm 2 is connected to the pivotal point C, while the end of the parallel arm 3 is directly connected to the piston 21 contained in the cylinder 20**. Operation will be carried out in the same manner as in the first preferred embodiment.

Figure 5:
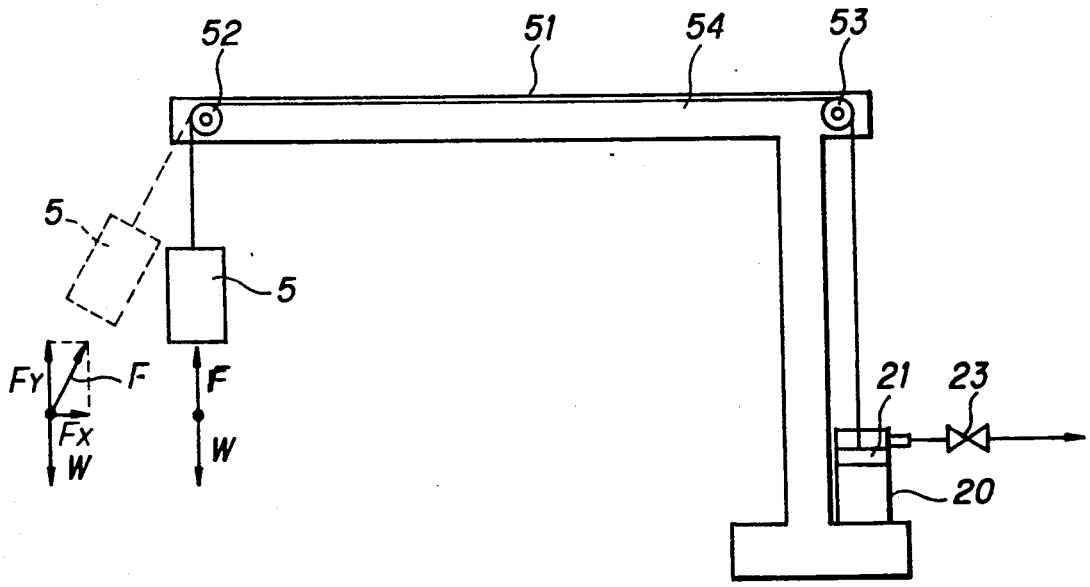

FIG. 5 shows an apparatus for practice of ambulation in the third preferred embodiment according to the invention. The apparatus for practice of ambulation comprises a structural member 51 of an L-shape, a wire 54 suspended on reels 52 and 53 provided in the structural member 51, a load sensor 5 provided at a first end of the wire 54, and a cylinder 20 having a piston 21 connected to a second end of the wire 54, wherein the cylinder 20 is connected via a valve 23 to an air pressure source (not shown).

In operation, when a person suspended by a suspension device walks on a predetermined path, a suspension load W is balanced relative to an opposite direction suspension force F, so that the person carries out the practice of ambulation in a state that the person is suspended by the suspension force F. In this situation, if the person walks out of the path to the left, the suspension force F generated from the wire 54 is inclined as indicated by the load sensor 54 of the dotted line. The inclined suspension force F is divided into a vertical component $F_Y$ and a horizontal component $F_X$, so that the vertical component $F_Y$ is balanced relative to the suspension load W, and the horizontal component $F_X$ functions to restore the walking person to the path.

In the first to third preferred embodiments, the cylinder 20 may be replaced by a suspension force generating apparatus such as an electric motor, etc.

Figure 6A:
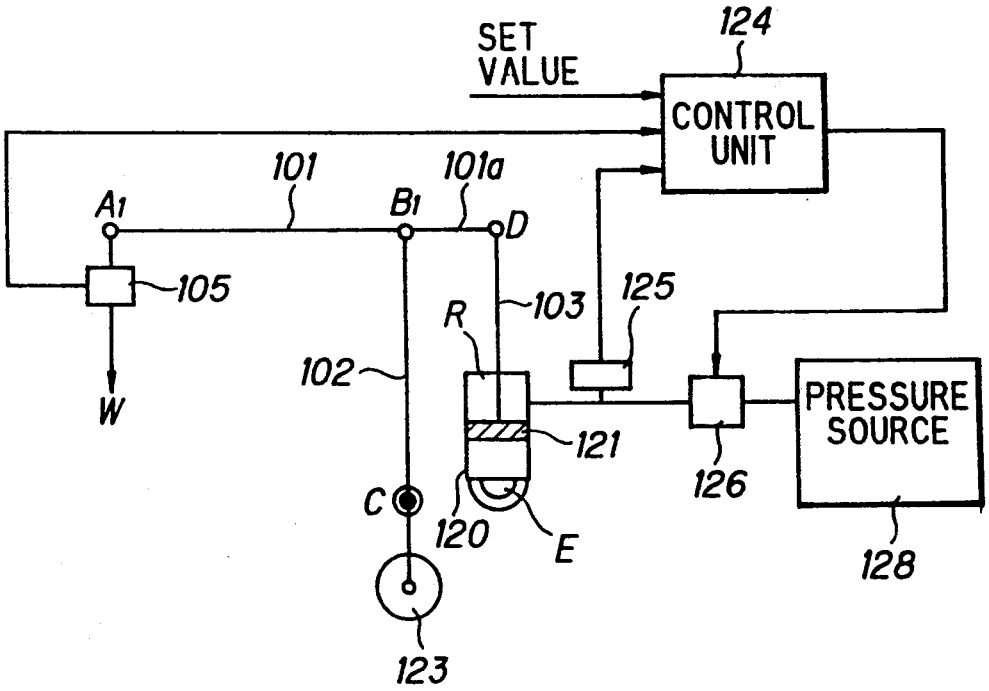
FIGS. 6A and 6B are explanatory diagrams showing an apparatus for practice of ambulation in a fourth preferred embodiment according to the invention.
Figure 6B:
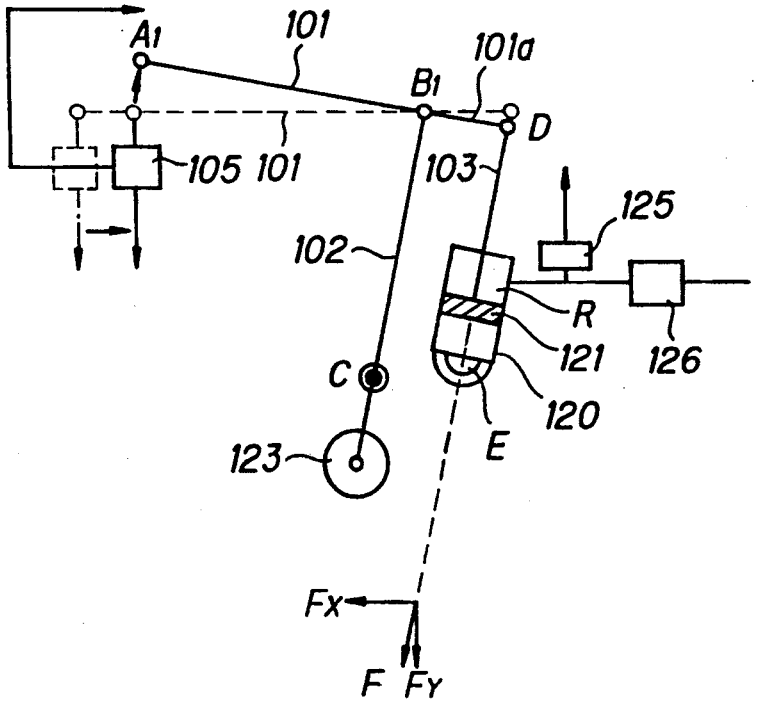

FIGS. 6A and 6B show an apparatus for practice of ambulation in the fourth preferred embodiment according to the invention. The apparatus comprises a parallel arm 102 which is fixed at a pivotal point C to be rotated, a parallel arm 103 which is connected to a piston 121 contained in a cylinder 120 fixed at a pivotal point E to be inclined, a counter weight 123 fixed at the pivotal point C for making a balance at the time of no load, a connecting arm **101*a* for connecting the parallel arms 102 and 103 at joint points $B_1$ and D, a horizontal arm 101 connected at the joint point $B_1$ to the parallel and connecting arms 102 and 101*a*, a load sensor 105 connected at a joint point $A_1$ to the horizontal arm 101 to detect a suspension load W, a pressure sensor 125 for detecting an internal pressure of a pressure chamber R of the cylinder 120, a regulator 126 connected to a pressure source 128 for controlling the internal pressure of the pressure chamber R, and a control unit 124 for controlling the regulator 126 by receiving a set value and output signals of the load sensor 105 and the pressure sensor 125. A chamber which is opposite to the pressure chamber R in the cylinder 120** is communicated to outer atmosphere.

In operation, a person who wants to make practice of ambulation sets a desired suspension force by using ten keys of an input board for the control unit 124, so that the person is suspended by the input suspension force. The control unit 24 calculates a pressure set value, which is proportional to the input suspension force, to be supplied to the regulator 126, so that the internal pressure of the cylinder pressure chamber R is controlled to be a predetermined pressure. As a result, a predetermined suspension force is applied to the parallel arm 103, so that a ratio of the weight of the person is shared by the suspension force, while a remaining ratio of the weight is supported by the person. When the person walks out of a predetermined path (shift from dotted line state to solid line state as shown in FIG. 2B), the parallel arms 102 and 103 are inclined by the rotation of the cylinder 120 in the clockwise direction, so that a distance $\overline{DE}$ is increased to provide a displacement of the piston 121 in the cylinder 120. As a result, the internal pressure of the cylinder pressure chamber R is proportionally increased. On the contrary, this increased internal pressure is suppressed to be the set value by the regulator 126. At the same time, a position level of the load sensor 105 is increased to increase a detected load of the load sensor 105, so that a newly set pressure value is applied to the regulator 126 to increase the suspension force. In more precisely, a suspension force F generated along the parallel arm 103 is of an inclined vector direction which is divided into a vertical component Fy ($=F\cdot\cos\theta$) and a horizontal component Fx ($=F\cdot\sin\theta$). Therefore, the generating force is increased to "$F/\cos\theta$" to provide a constant vertical component as indicated below.

$$Fy=(F/\cos\theta)\cdot\cos\theta=F$$

As a result, the horizontal component Fx is calculated as indicated below.

$$Fx=(F/\cos\theta)\cdot\sin\theta$$

This horizontal component is a restoring force, by which the person walking out of the path is restored to a predetermined path.

Figure 7:
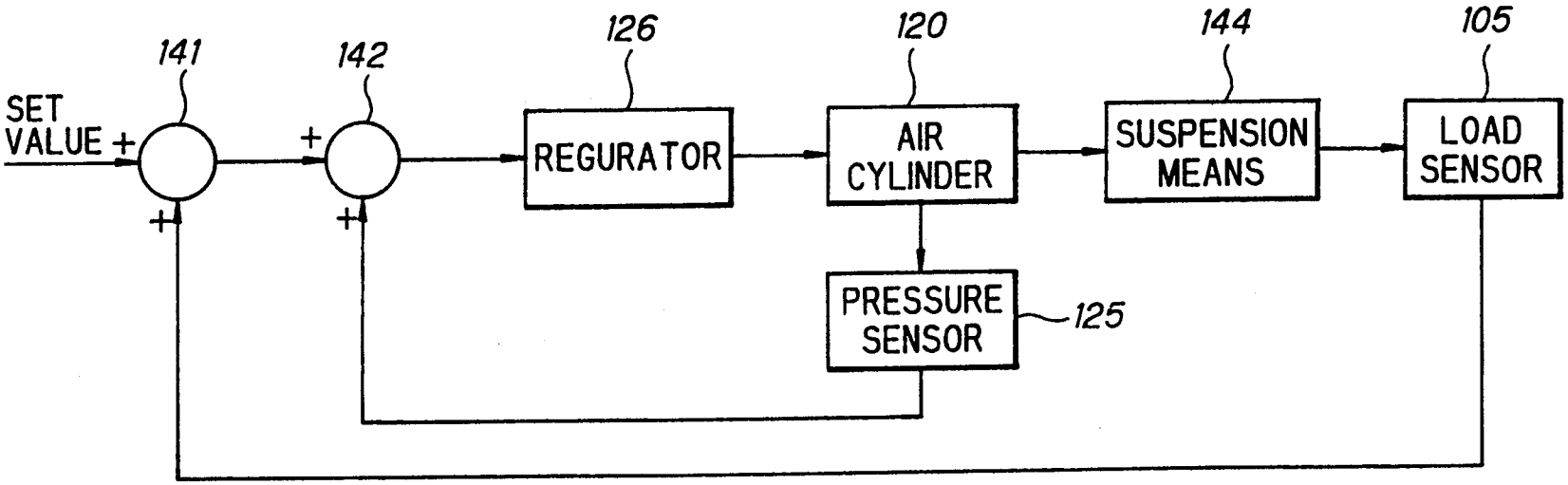
FIG. 7 is a block diagram showing a control system in the fourth preferred embodiment.

FIG. 7 shows the above described control loop, in which a set value of the suspension force is applied via adders 141 and 142 to the regulator 126 for generating a pressure applied to the cylinder 120. Then, a suspension force which is dependent on the set value is generated at the top end of the horizontal arm 101. When a detected value of the pressure sensor 125 is changed, the air cylinder 120 is controlled to provide an internal pressure which is determined by the set value of the suspension force. On the other hand, when a detected value of the load sensor 105 is changed, a newly set pressure value is applied to the cylinder 120. The adders 141 and 142 add the detected values of the both sensors 105 and 125 to the set value, respectively, and the added value is supplied to the regulator 143. Consequently, even if the aforementioned inclination angle $\theta$ is changed, a walking person can be suspended by a predetermined suspension force. In this control loop, a loop of the load sensor 105 and the adder 141 may not be provided.

Figure 8:
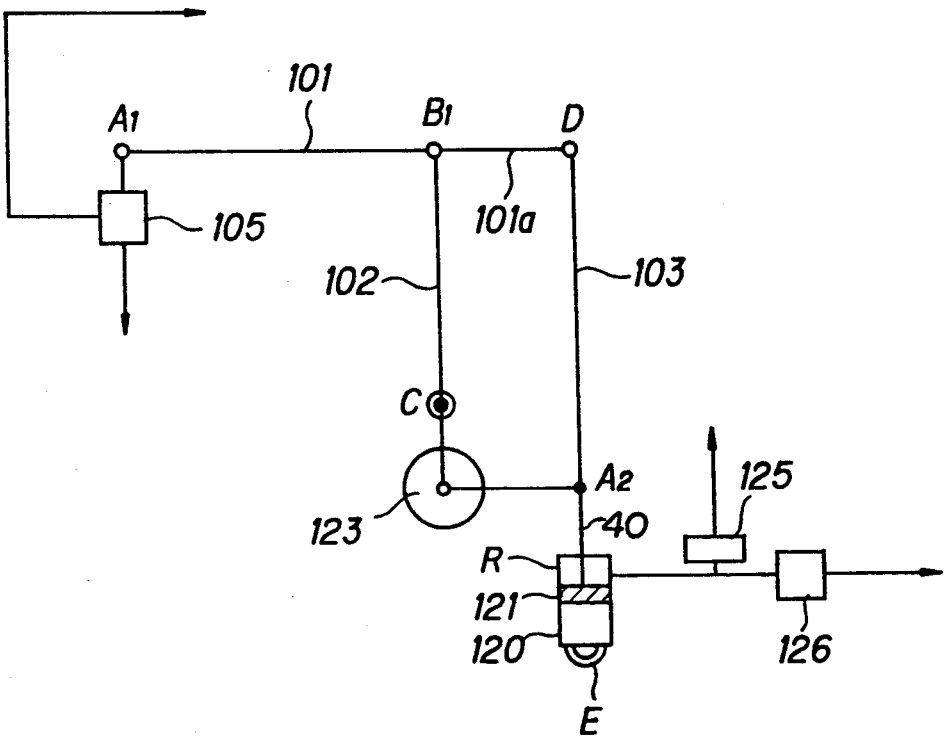
FIG. 8 is an explanatory diagram showing an apparatus for practice of ambulation in a fifth preferred embodiment according to the invention.

FIG. 8 shows an apparatus for practice of ambulation in the fifth preferred embodiment according to the invention, wherein like parts are indicated by like reference numerals as used in FIGS. 6A and 6B. In this fifth preferred embodiment, a piston rod 4 connected to the piston 121 contained in the cylinder 20 is connected to a joint point $A_2$, and the parallel arm 103 and the piston rod 40 are rotated in clockwise and counter clockwise directions on the joint point $A_2$, so that the cylinder 120 can be inclined to adjust an internal pressure of the pressure chamber R in the cylinder 120 in the same manner as in the fourth preferred embodiment.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. An apparatus for practice of ambulation, comprising:

means for suspending a person making practice of ambulation by a predetermined suspension force;

means for generating said predetermined suspension force; and means for generating a restoring force to restore said person to a predetermined path when said person is outside of said predetermined path, said suspension force generating means being pivoted on a fixed point to be allowed to perform clockwise and counter clockwise rotations;

said means for generating said suspension force becoming inclined by said clockwise and counter clockwise rotations on said fixed point when the person is outside of said predetermined path, said restoring force being generated in accordance with inclination of said means for generating said suspension force.

2. An apparatus for practice of ambulation, according to claim 1, wherein:

said suspension force generating means is one selected from a piston contained in a cylinder for providing a fluid pressure and an electric motor; and said restoring force generating means is a pivotal means for fixing said suspension force generating means to a pivotal point to be rotated.

3. An apparatus for practice of ambulation, according to claim 1, wherein:

said suspension force generating means is one selected from a piston contained in a cylinder for providing a fluid pressure and an electric motor; and said restoring force generating means is a wire for conveying said suspension force to said suspending means.

4. An apparatus for practice of ambulation, comprising:

means for suspending a person making practice of ambulation by a predetermined suspension force;

means for generating said predetermined suspension force;

means for generating a restoring force to restore said person to a predetermined path when said person is outside of said predetermined path;

said suspension force generating means being pivotable on a fixed point so as to take an inclined position in response to detecting that said person is outside of said predetermined path, said restoring force being generated in accordance with an inclination of said suspension force generating means; and means for controlling said suspension force generating means to generate a predetermined value of said suspension force;

wherein said controlling means controls said suspension force generating means to generate a suspension force having a constant value of a vertical component.

* * * * *